US009335047B2

(12) United States Patent
Okuma et al.

(10) Patent No.: US 9,335,047 B2
(45) Date of Patent: May 10, 2016

(54) GLOW PLUG AND METHOD FOR MANUFACTURING SAME

(71) Applicant: NGK SPARK PLUG CO., LTD., Nagoya, Aichi (JP)

(72) Inventors: Takeshi Okuma, Aichi (JP); Shuei Ishii, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/388,067

(22) PCT Filed: Mar. 6, 2013

(86) PCT No.: PCT/JP2013/001391
§ 371 (c)(1),
(2) Date: Sep. 25, 2014

(87) PCT Pub. No.: WO2013/145571
PCT Pub. Date: Oct. 3, 2013

(65) Prior Publication Data

US 2015/0300642 A1 Oct. 22, 2015

(30) Foreign Application Priority Data

Mar. 29, 2012 (JP) ..... 2012-075293

(51) Int. Cl.
*F23Q 7/00* (2006.01)
*B21D 22/20* (2006.01)

(52) U.S. Cl.
CPC ..... *F23Q 7/001* (2013.01); *B21D 22/20* (2013.01); *F23Q 2007/004* (2013.01)

(58) Field of Classification Search
CPC ..... G01L 23/22
USPC ..... 123/169 PA, 260; 313/118, 141, 143; 219/267, 270, 526, 534, 553
See application file for complete search history.

(56) References Cited

U.S. PATENT DOCUMENTS

| | | | | |
|---|---|---|---|---|
| 6,027,334 | A | 2/2000 | Blaschke | 431/261 |
| 6,373,173 | B1 * | 4/2002 | Suzuki | H01T 13/36 313/135 |
| 2001/0015402 | A1 | 8/2001 | Murai et al. | 248/554 |

FOREIGN PATENT DOCUMENTS

| | | | | |
|---|---|---|---|---|
| DE | 102006014215 | A1 * | 9/2007 | B21D 22/21 |
| EP | 0798515 | A2 | 10/1997 | F23Q 7/00 |

(Continued)

OTHER PUBLICATIONS

International Search Report from corresponding International Patent Application No. PCT/JP13/01391 (English-language translation provided).

(Continued)

*Primary Examiner* — Thien S Tran
(74) *Attorney, Agent, or Firm* — Kusner & Jaffe

(57) ABSTRACT

A glow plug includes a cylindrical housing having an axial hole which extends in the direction of an axis and provided with, on an outer circumferential surface thereof, a screw portion for being screwed into a mounting hole of an internal combustion engine, and a heater member inserted into the axial hole in a state where at least front end portion thereof projects from a front end of the housing. The housing includes a tool engagement portion which is provided at a rear end side than the screw portion and to which a tool is engaged when the being mounted to the internal combustion engine. An inner circumference of the tool engagement portion has a shape which follows an outer circumferential shape of the tool engagement portion.

5 Claims, 7 Drawing Sheets

(56) References Cited

FOREIGN PATENT DOCUMENTS

| | | | | |
|---|---|---|---|---|
| EP | 1328138 A1 | 7/2003 | ..... | H05B 3/44 |
| FJ | 2001-182937 | 7/2001 | ..... | F23Q 7/00 |
| JP | 58-182033 | 10/1983 | ..... | F23Q 7/00 |
| JP | H 10506982 A | 7/1998 | ..... | F01N 3/025 |
| JP | 2010210102 A | 9/2010 | ..... | F23Q 7/00 |
| JP | 2010249354 A | 11/2010 | ..... | F02P 19/00 |

OTHER PUBLICATIONS

Search Report issued in corresponding European Patent Application No. 13768466.8, dated Dec. 17, 2015.

* cited by examiner

GLOW PLUG AND METHOD FOR MANUFACTURING SAME

FIELD OF THE INVENTION

The present invention relates to a glow plug used to preheat a diesel engine and the like, and a method for manufacturing the same.

BACKGROUND OF THE INVENTION

Glow plugs, which are used in assisting a start of an internal combustion engine, such as a diesel engine, include a tubular housing and a heater member which is energized to be heated. The heater member may be a ceramic heater having a heating element made of a conductive ceramic or a sheathed heater having a heating coil.

The housing has a screw portion dimensioned to be screwed into a mounting hole of the internal combustion engine and a tool engagement portion dimensioned to engage a tool when said housing is mounted to the internal combustion engine. An outer circumference of the tool engagement portion has a shape, e.g., a hexagonal shape in cross section, which allows the engagement of a tool, such as a wrench, whereby when the glow plug is mounted to the internal combustion engine, a force is applied along a circumferential direction of the tool engagement portion.

Further, an inner circumferential portion of such a tool engagement portion is generally formed into a circular shape in cross section by a cutting process, a forging process or the like. In a cutting process, a lathing operation is effected by means of a drill, a cutting bit or the like, and in a forging process, a round rod-like core metal is pushed into a rear end portion of the tool engagement portion (refer to, for example, JP-A-2010-210102).

Since the circumferential force is applied to the tool engagement portion when the glow plug is mounted to the internal combustion engine, the tool engagement portion needs a mechanical strength by which the tool engagement portion is able to withstand the applied circumferential force. Because of this, the thickness of the tool engagement portion should be equal to or larger than a predetermined value.

When the outer circumference of the tool engagement portion is formed into the hexagonal shape in cross section and the inner circumference is formed into the circular shape in cross section, in the event that the thickness of the thinnest portion of the tool engagement portion is set to the predetermined value, portions other than the thinnest portion of the tool engagement portion will be formed thicker than required. Consequently, the weight of the tool engagement portion and hence the weight of the housing becomes relatively large. As a result, there is concern that the fuel economy of the vehicle is deteriorated or the manufacturing cost of the glow plug is increased.

The invention has been made in view of the situations described above. An object of the present invention is to provide a glow plug which can realize an improvement in fuel economy or a reduction in manufacturing cost by reducing the weight of a tool engagement portion and hence the weight of a housing thereof, and a method for manufacturing the same.

SUMMARY OF THE INVENTION

Hereinafter, configurations suitable for achieving the object will be described item by item. It is noted that specific working effects specific to the configurations will be described additionally, as required.

Configuration 1.

In accordance with a first aspect of the present invention, there is provided a glow plug including:

a cylindrical housing having an axial hole which extends in a direction of an axis and provided with, on an outer circumferential surface thereof, a screw portion for being screwed into a mounting hole of an internal combustion engine; and a heater member inserted into the axial hole in a state where at least a front end portion thereof projects from a front end of the housing, the housing includes a tool engagement portion which is provided at a rear end side relative to the screw portion, said tool engagement portion dimensioned to engage a tool when said glow plug is mounted to the internal combustion engine, characterized in that:

an inner circumference of the tool engagement portion has a shape which follows an outer circumferential shape of the tool engagement portion.

Configuration 2.

In accordance with a second aspect of the present invention, there is provided a glow plug as described in Configuration 1, wherein, in a cross-sectional plane perpendicular to the axis, an outer circumference of the tool engagement portion has a hexagonal shape, and any one of the following (a) to (c) is satisfied.

(a) a distance between opposite sides of the tool engagement portion is 8 mm, and a thickness of the tool engagement portion is 0.8 mm or smaller;

(b) the distance between the opposite sides of the tool engagement portion is 9 mm or 10 mm, and the thickness of the tool engagement portion is 1.0 mm or smaller;

(c) the distance between the opposite sides of the tool engagement portion is 12 mm, and the thickness of the tool engagement portion is 1.5 mm or smaller.

Configuration 3.

In accordance with a third aspect of the present invention, there is provided a glow plug as described in Configuration 1 or 2, wherein the glow plug further includes:

a center pole extending in the direction of the axis, said center pole inserted through the axial hole and electrically connected with the heater member; and an annular seal member in contact with the inner circumference of the tool engagement portion and an outer circumference of the center pole;

the housing has an annular step portion which is located on the inner circumference of the tool engagement portion, which projects radially inwards, and to which the seal member contacts, and when an outer circumferential surface of the tool engagement portion and the step portion are projected along the axis on a plane perpendicular to the axis, an area of a projected region of the step portion is 30% or larger of an area of a region which is surrounded by a projected line of the outer circumferential surface of the tool engagement portion.

Configuration 4.

In accordance with a fourth aspect of the present invention, there is provided a glow plug as described in Configurations 1 to 3, wherein the tool engagement portion has a uniform thickness.

As used/herein, the description of "has a uniform thickness" includes not only a case where the respective thicknesses of the portions of the tool engagement portion are strictly the same but also a case where the respective thicknesses of the portions differ slightly (for example, by 0.5 mm or smaller).

Configuration 5.

In accordance with a fifth aspect of the present invention, there is provided a method for manufacturing the glow plug as described in Configurations 1 to 4, the method including:

a housing forming process of forming the housing;

characterized in that:

the housing forming process includes a step of forming a cylindrical housing intermediate product, which is to become the housing, by performing deep drawing processing to a plate-shaped metal material.

Advantage of the Invention

According to the glow plug of the Configuration 1, the inner circumference of the tool engagement portion has a shape which follows the outer circumferential shape of the tool engagement portion (similar shapes in which apexes correspond to each other, and more particularly, when the outer circumference of the tool engagement portion is hexagonal in cross section, the inner circumference of the tool engagement portion also has a hexagonal shape in cross section which has sides parallel to sides of the hexagonal shape of the outer circumference of the tool engagement portion). Consequently, it is possible to prevent the thickness of the tool engagement portion from being increased locally, whereby the weight of the tool engagement portion and hence the weight of the housing can be reduced. As a result, it is possible to realize an improvement in fuel economy and a reduction in manufacturing cost.

According to the glow plug of the Configuration 2, the tool engagement portion can be formed sufficiently thin, whereby the weight of the housing can be reduced further. Consequently, it is possible to realize more effectively the improvement in fuel economy and the reduction in manufacturing cost.

The gastightness in the interior of the housing is ensured by providing an annular seal member between the inner circumference of the tool engagement portion and the outer circumference of the center pole and bringing the seal member into contact with a step portion which is provided on the inner circumference of the tool engagement portion. Here, it is preferable to increase the contact area of the seal member with the step portion by increasing the area of the step portion from the viewpoint of realizing an improvement in gastightness. However, when the inner circumference of the tool engagement portion is circular in cross section as in the conventional technique described above, it is very difficult to increase the area of the step portion while maintaining the strength of the tool engagement portion.

In this respect, by adopting the Configuration 1 or the like and forming the inner circumference of the tool engagement portion into the shape which follows the outer circumferential shape of the tool engagement portion, like the glow plug of the Configuration 3, the area of the projected region of the step portion can be 30% or larger of the area of the region which is surrounded by the projected line of the outer circumferential surface of the tool engagement portion. Consequently, the contact area of the seal member with the step portion can be significantly increased. As a result, an extremely good gastightness can be realized.

According to the glow plug of the Configuration 4, the thickness of the tool engagement portion is uniform. Consequently, the tool engagement portion can be formed thin as a whole, and the weight of the housing can be reduced further. As a result, it is possible to realize more effectively the improvement in fuel economy and the reduction in manufacturing cost.

According to the method for manufacturing the glow plug of the Configuration 5, the housing intermediate product, which is to become the housing, is manufactured by deep drawing processing. Consequently, the housing can be formed relatively thin as a whole, and the housing which is light in weight can be manufactured more easily. As a result, it is possible to realize an improvement in productivity.

In addition, since the housing can be made thin as a whole, it is possible to realize a further reduction in weight of the housing. As a result, it is possible to realize not only an improvement in fuel economy but also a reduction in manufacturing cost more effectively.

BRIEF DESCRIPTION OF DRAWINGS

In FIG. 6, (a) is a partially cutaway front view showing a die and a punch which are used in forming the tool engagement portion, and (b) is a partially cutaway front view showing a die in which the housing intermediate product is disposed and the like.

DETAILED DESCRIPTION OF THE PREFERRED EMBODIMENTS

Figure 1:
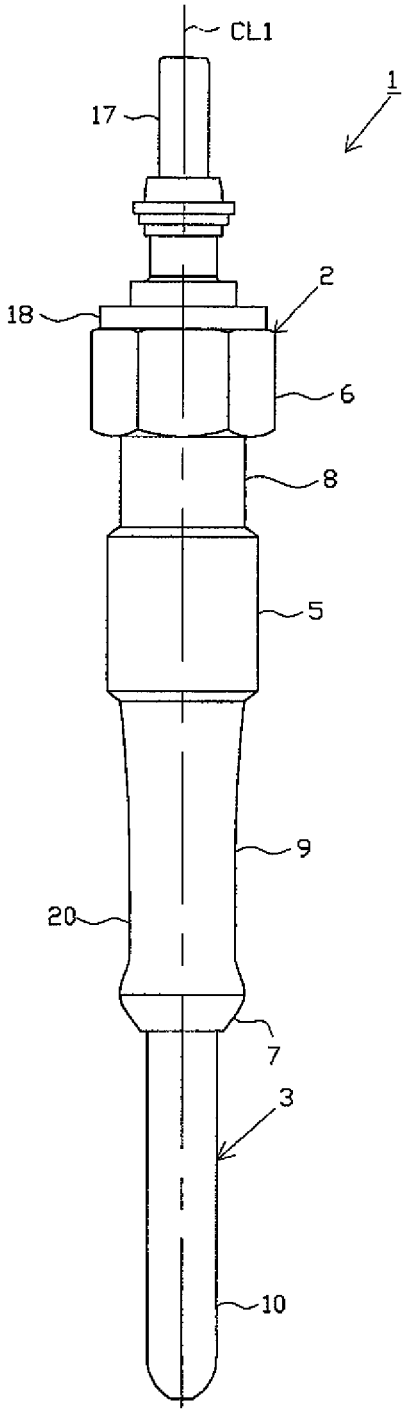
FIG. 1 is a front view of a glow plug.
Figure 2:
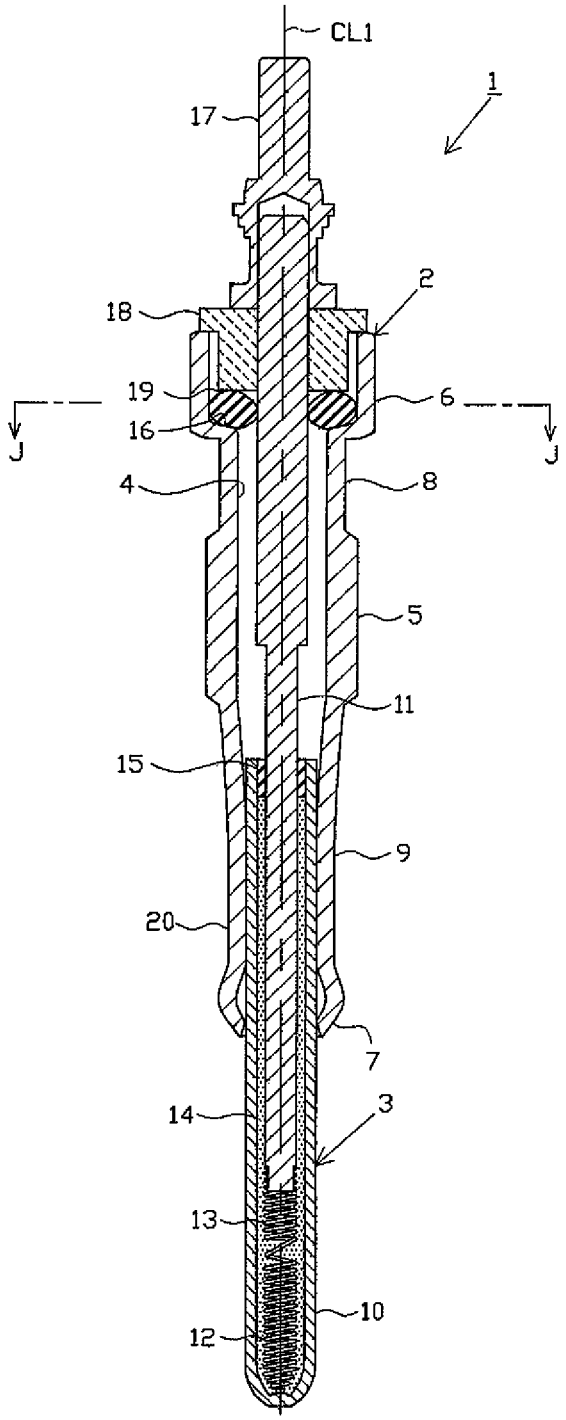
FIG. 2 is a partially cutaway front view of the glow plug.

Referring to the drawings, an embodiment will be described. FIG. 1 is a front view of a glow plug 1, and FIG. 2 is a partially cutaway front view of the glow plug 1. In FIG. 1 and the other drawings, a direction of an axis CL1 of the glow plug 1 will be referred to as a vertical direction in the drawings, and a lower side will be referred to as a front end side, whereas an upper side will be referred to as a rear end side of the glow plug 1.

As shown in FIGS. 1 and 2, the glow plug 1 includes a cylindrical housing 2 and a heater member 3 which is mounted to the housing 2.

The housing 2 is formed of a predetermined metal (for example, carbon steel, stainless steel or the like) and has an axial hole 4 which penetrates therethrough in the direction of the axis CL1. The housing has a screw portion 5 dimensioned to be screwed into a mounting hole of an internal combustion engine such as a diesel engine or the like. A tool engagement portion 6, having a hexagonal cross section, is provided at a rear end side of the screw portion 5. The tool engagement portion 6 is dimensioned to engage a tool such as a torque wrench or the like when the glow plug 1 is being mounted in the internal combustion engine. The screw portion 5 and the tool engagement portion 6 are formed on an outer circumferential surface of the housing 2. The configuration of the tool engagement portion 6 will be described in detail later.

Further, the housing 2 includes a pressure contact portion 7 at a front end portion thereof which is brought into pressure contact with a seat surface (not shown) of the internal combustion engine when the screw portion 5 is screwed into the mounting hole. The pressure contact portion 7 has a tapered shape in which an outer diameter thereof gradually reduces as it extends towards the front end side. Gastightness is ensured in a combustion chamber by the pressure contact portion 7 being brought into pressure contact with the seat surface. In addition, the housing 2 includes a rear-end-side body portion 8 which is located between the screw portion 5 and the tool engagement portion 6 and a front-end-side body portion 9 which is located between the pressure contact portion 7 and the screw portion 5. The rear-end-side body portion 8 has a cylindrical shape and is configured so as to have a constant outer diameter along the direction of the axis CL1. On the other hand, the front-end-side body portion 9 is curved on an outer circumferential surface and an inner circumferential surface thereof, has a smallest hole diameter in the axial hole 4 and includes a holding portion 20 which holds the heater member 3 on the inner circumferential surface. In this embodiment, the housing 2 is thin as a whole and has a substantially uniform thickness. The holding portion 20 has a smallest outer diameter in the front-end-side body portion 9.

The heater member 3 includes a tube 10, as well as a heating coil 12 and a control coil 13 which are disposed in an inside of the tube 10 and is connected in series with a center pole 11 which is made of a predetermined metal (for example, an iron-based alloy or the like). Additionally, the heater member 3 is press fitted in the holding portion 20 with a front end portion thereof projecting from a front end of the housing 2 to thereby be fixed to the housing 2.

The tube 10 is formed of a metal which contains iron (Fe) or nickel (Ni) as a main composition (for example, a nickel-based alloy, a stainless steel alloy or the like) and is a cylindrical tube which is closed at a front end portion. The heating coil 12, which is joined to a front end of the tube 10 at a front end portion thereof, and the control coil 13, which is connected in series with a rear end portion of the heating coil 12, are sealed in an inside of the tube 10 together with insulation powder 14 which contains magnesium oxide powder. Although the heating coil 12 electrically conducts with the tube 10 at a front end thereof, outer circumferential surfaces of the heating coil 12 and the control coil 13 and an inner circumferential surface of the tube 10 are insulated from each other by the insulation powder 14 interposed therebetween.

Further, an annular seal 15 which is made of a predetermined rubber (for example, silicone rubber, fluororubber or the like) is provided between an inner circumference of a rear end side of the tube 10 and the center pole 11, whereby the interior of the tube 10 is sealed.

The heating coil 12 is configured by winding a resistance heating wire which is made of a predetermined metal (for example, an alloy containing AL, Cr or the like in addition to Fe as a main composition, or the like) into a spiral shape. The heating coil 12 generates heat by being energized via the center pole 11.

The control coil 13 is made of a material having a larger temperature coefficient of an electric specific resistance than that of the material of which the heating coil 12 is made, for example, a resistance heating wire which contains as a main composition Co or Ni which is represented by a cobalt (Co)—Ni—Fe based alloy or the like. By being so made, the control coil 13 increases an electric resistance value by generating heat in itself and receiving heat generated by the heating coil 12 therefrom to thereby control electric power supplied to the heating coil 12. Specifically, a relatively large magnitude of electric power is supplied to the heating coil 12 at an initial stage of energization, whereby the temperature of the heating coil 12 is raised. Then, the control coil 13 is heated as a result of the heating coil 12 being heated, and this increases the electric resistance value of the control coil 13, whereby the supply of electric power to the heating coil 12 is reduced. The temperature rising characteristic of the heater member 3 is such that the temperature of the heater member 3 rises quickly at the initial stage of energization, whereafter the temperature thereof does not increase any further by the supply of electric power being suppressed by the action of the control coil 13. Namely, the existence of the control coil 13 makes it difficult for an excessive rise (an overshoot) in temperature of the heating coil 12 to occur while enhancing the quick temperature raising characteristic of the heater member 3.

The center pole 11 is formed as a solid rod-like member and a front end portion thereof is inserted into the interior of the tube 10. Then, with a frontmost end portion of the center pole 11 inserted in a rear end portion of the control coil 13, the center pole 11 and the control coil 13 are resistance welded together, whereby the center pole 11 and the control coil 13 are connected together.

Further, a cable connecting terminal pin 17 having a bottomed cylindrical shape is fixed to a rear end portion of the center pole 11 through crimping. Additionally, an insulation bush 18 which is made of an insulation material is provided between a front end portion of the terminal pin 17 and a rear end portion of the housing 2 so as to prevent a direct energization (short-circuiting) between the terminal pin 17 and the housing 2.

An annular seal member 19, which is made of an insulating material (for example, silicone rubber, fluororubber or the like) and which is brought into contact with the housing 2 and the center pole 11, is provided between an inner circumference of the housing 2 (the tool engagement portion 6) and an outer circumference of the center pole 11 to realize an enhancement in gastightness in the axial hole 4 or the like. A step portion 16 is provided on the inner circumference of the housing 2 and this step portion 16 is located on an inner circumference of the tool engagement portion 6, projects radially inwards, and has an annular shape in which the axis CL1 serves as a center thereof. Additionally, the seal member 19 is pressed towards the front end side in the direction of the axis C1 by the insulating bush 18 as the terminal pin 17 is crimped and fixed, whereby a surface of the seal member 19 which is located at the front end side in the direction of the axis CL1 is brought into pressure contact with the step portion 16.

Figure 3:
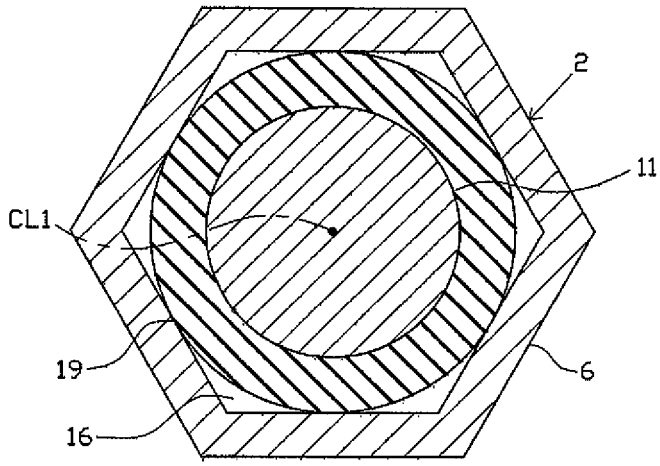
FIG. 3 is a cross-sectional view taken along the line J-J in FIG. 2.

Next, the configuration of the tool engagement portion 6 will be described in detail. In this embodiment, as shown in FIG. 3 (FIG. 3 is cross-sectional view taken along the line J-J in FIG. 2), an inner circumference of the tool engagement portion 6 is formed into a hexagonal shape in cross section, which follows an outer circumferential shape of the tool engagement portion 6. Additionally, the tool engagement portion 6 has a uniform thickness.

Further, in this embodiment, a distance between opposite sides of the tool engagement portion 6 is 12 mm, and the thickness of the tool engagement portion 6 is 1.5 mm or smaller. Meanwhile, in an embodiment where the distance between the opposite sides of the tool engagement portion 6 is 8 mm, the thickness of the tool engagement portion 6 is 0.8 mm or smaller. In an embodiment where the distance between the opposite sides of the tool engagement portion 6 is 9 mm or 10 mm, the thickness of the tool engagement portion 6 is 1.0 mm or smaller. However, it is preferable that the thickness of the tool engagement portion 6 is a predetermined value (for example, 0.3 mm) or larger to ensure a sufficient mechanical strength for the tool engagement portion 6.

Figure 4:
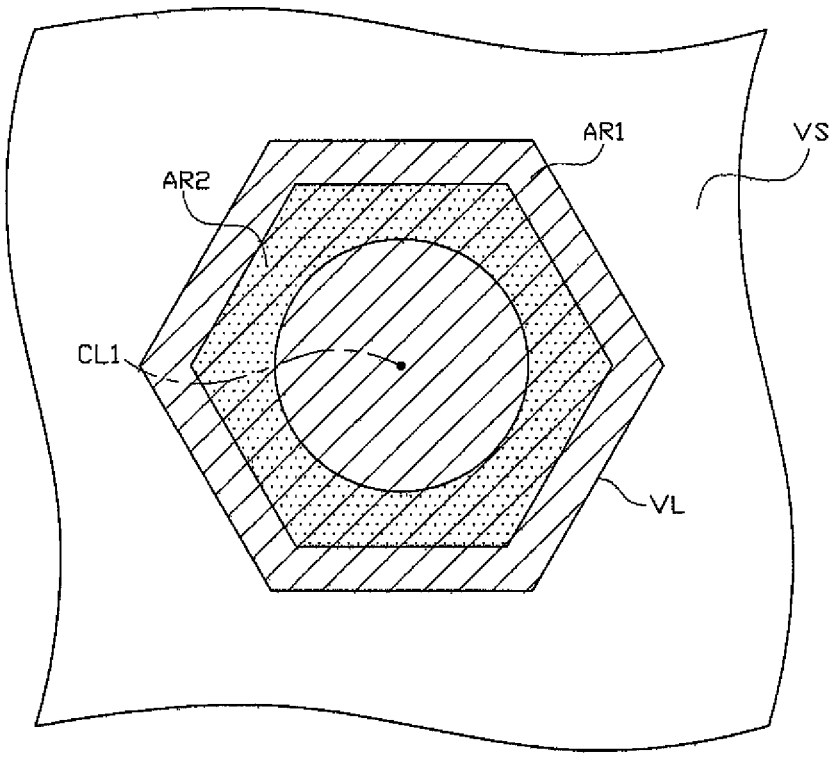
FIG. 4 a projection drawing showing an outer circumferential surface of a tool engagement portion, a step portion, and the like, which are projected on a plane perpendicular to an axis, In FIG. 5, (a) is a perspective view of a metal material, (b) to (d) are front views showing a transition of a shape of the metal material through deep drawing processing, and (e) is a front view showing a housing intermediate product.

In addition, as shown in FIG. 4, when an outer circumferential surface of the tool engagement portion 6 and the step portion 16 are projected along the axis CL1 on a plane VS perpendicular to the axis CL1, an area of a projected region AR2 of the step portion 16 (in FIG. 4, a portion shaded with scattering dots) is 30% or larger than an area of a region AR1 which is surrounded by a projected line VL of an outer circumferential surface of the tool engagement portion 6 (in FIG. 4, a portion shaded with slant lines). In other words, a contact area of the seal member 19 with the step portion 16 is significantly increased.

Next, a method for manufacturing the glow plug 1 which is configured as has been described above will be described. It is noted that a conventional known method is adopted for portions which will not be described specifically.

Firstly, a resistance heating wire containing Cr or Al in addition to Fe as a main composition is processed into a coil shape to obtain the heating coil 12. Additionally, a rear end portion of the heating coil 12 and a front end portion of the control coil 13 which is formed by processing a resistance heating wire of a Co—Ni—Fe-based alloy into a coil shape are joined together through arc welding or the like.

Next, a front end of the center pole 11, and the heating coil 12 and the control coil 13 which are integrated with a front end of the center pole 11 are disposed within the cylindrical tube 10 which is formed larger in diameter by a working margin than a final dimension thereof and of which a front end is not closed.

Then, a front end portion of the tube 10 is closed, and the front end portion of the tube 10 and a front end portion of the heating coil 12 are joined together through arc welding.

Thereafter, after the insulation powder 14 is filled in the tube 10, the tube 10 is swaged to obtain the heater member 3 into which the tube 10 and the center pole 11 are integrated.

Figure 5:
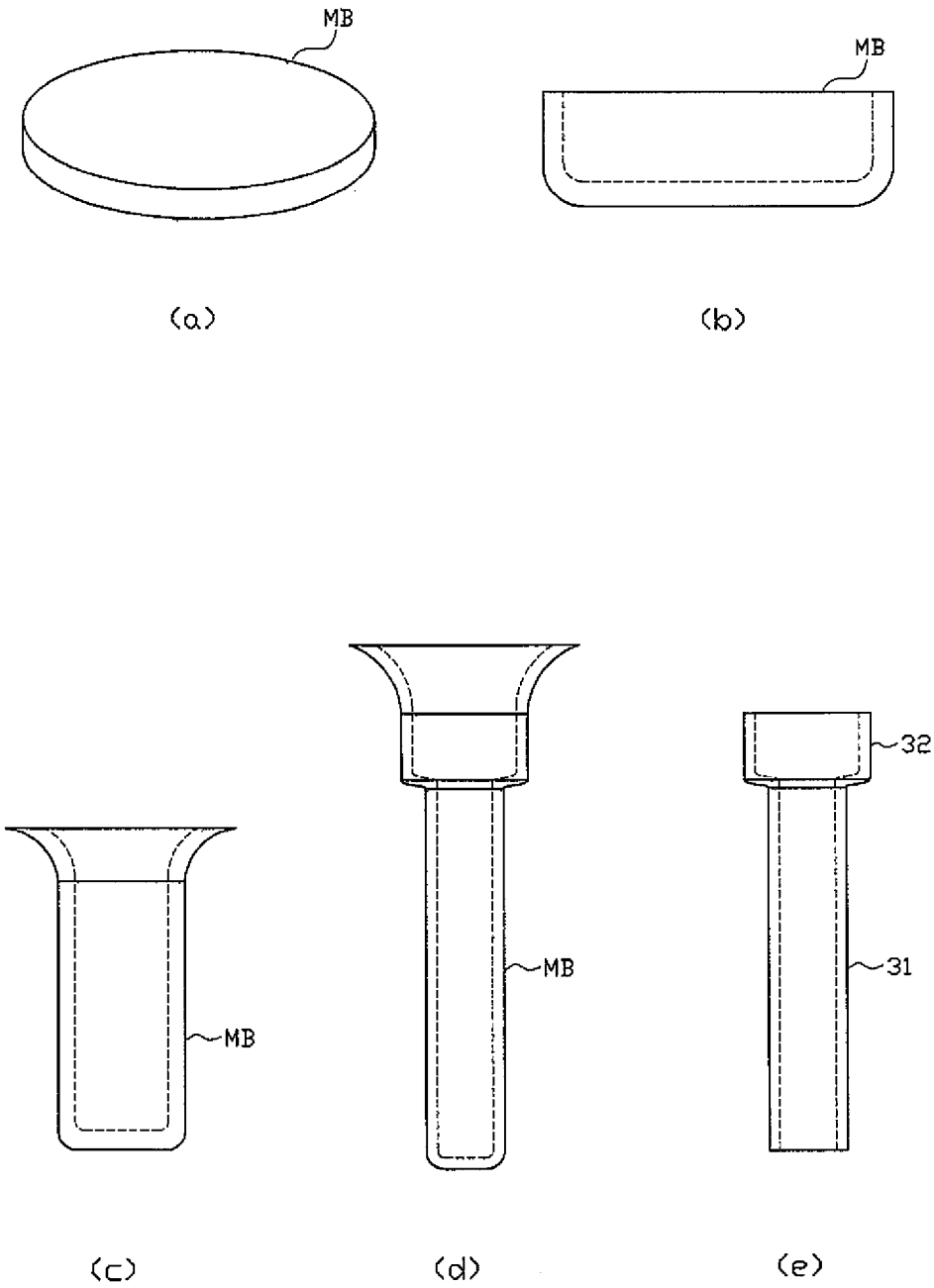

Next, in a housing forming process, the housing 2 is manufactured. Firstly, as shown in FIG. 5(*a*), a circular disk-shaped metal material MB which is made of a predetermined iron-based material is prepared. A deep drawing processing is performed to the metal material MB to obtain a cylindrical housing intermediate product which is to become the housing 2. Specifically, the metal material MB is supplied to a transfer press (not shown) in which a plurality of rod-shaped punches (not shown), which have different outer diameters that get smaller in a gradual fashion, and a plurality of bottomed cylindrical dies (not shown), which have different hole diameters corresponding to the outer diameters of the punches, are mounted to be aligned with each other. Then, the metal material MB is pressed in a plurality of stages by using the punches and the dies, whereby the metal material MB is formed into a cylindrical shape and the depth of the cylindrical shape is gradually increased as shown in FIGS. 5(*b*) to (*d*). Then, finally, both end portions of the metal material MB are cut to thereby obtain a cylindrical housing intermediate product 31 with a generally uniform thickness as a whole as shown in FIG. 5(*e*). The housing intermediate product 31 has an engagement-portion corresponding portion 32 at one end thereof. The engagement-portion corresponding portion 32 has a relatively large diameter that corresponds to the tool engagement portion 6.

Figure 6:
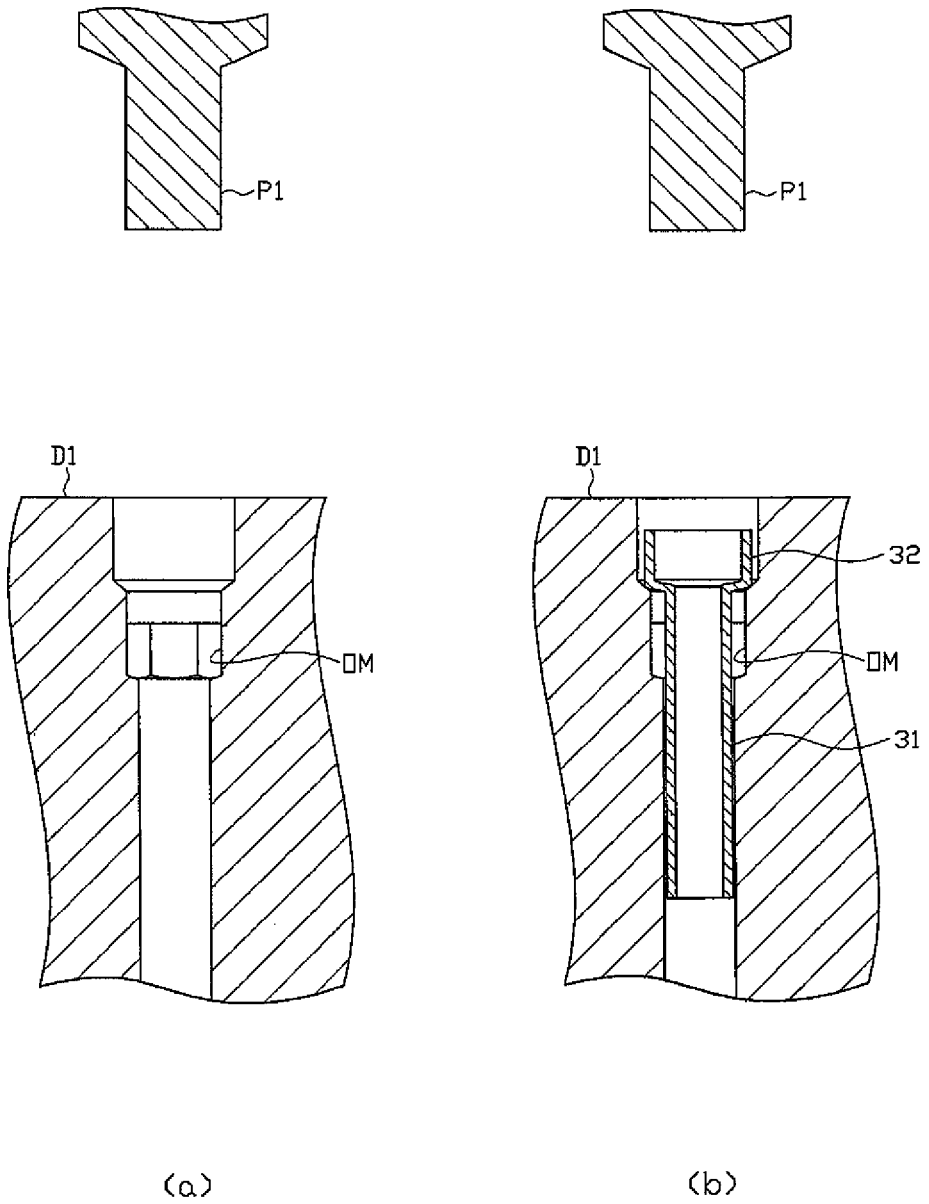
Figure 7:
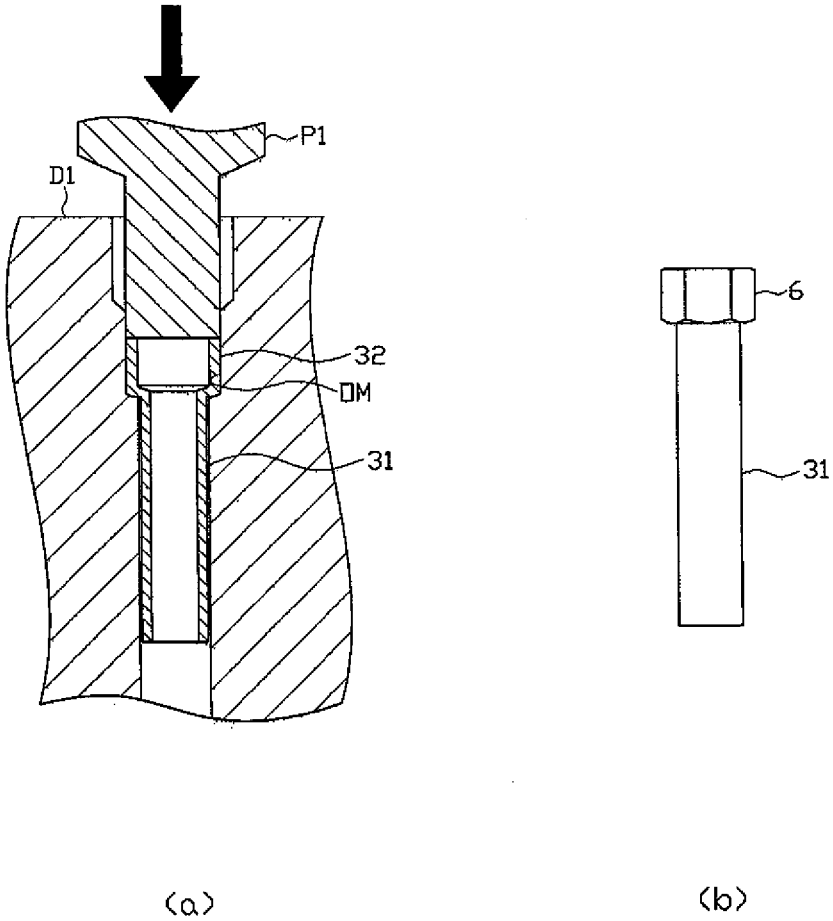
In FIG. 7, (a) is a partially cutaway front view showing one step of a tool engagement portion forming process, and (b) is a front view showing a housing intermediate product on which a tool engagement portion is formed.

Next, as shown in FIG. 6(*a*), by using a die D1 which has on an inner circumference thereof an outer circumference forming portion OM which has a shape corresponding to an outer circumferential shape of the tool engagement portion 6 and a vertically moveable punch P1, the tool engagement portion 6 is formed. To describe this in detail, firstly, as shown in FIG. 6(*b*), the housing intermediate product 31 is disposed in an inner circumference of the die D1. Then, as shown in FIG. 7(*a*), the punch P1 is lowered, so that the engagement-portion corresponding portion 32 is pushed into the outer circumference forming portion OM in the die D1 by the punch P1. By doing so, both an outer circumference and inner circumference of the engagement-portion corresponding portion 32 are formed into a hexagonal shape in section, whereby a tool engagement portion 6 is formed as shown in FIG. 7(*b*).

Next, an outer circumference at a front end side of the housing intermediate product 31 is pressed so as to deform a portion thereof which corresponds to the front-end-side body portion 9, whereby the holding portion 20 is formed.

Thereafter, a screw portion 5 is formed at a predetermined portion of the housing intermediate product 31 through rolling. Further, a front end portion of the housing intermediate product 31 is pressed to be deformed in a curved fashion to thereby form a pressure contact portion 7, whereby a housing 2 is obtained.

Then, finally, the heater member 3 is press fitted into the holding portion 20 of the housing 2, and the insulating bush 18 and the seal member 19 are disposed on an outer circumference of a rear end portion of the center pole 11. Then, the terminal pin 17 is crimped and fixed to the rear end portion of the center pole 11, whereby the glow plug 1 is obtained.

Thus, as it has been described in detail above, according to this embodiment, the inner circumference of the tool engagement portion 6 has the shape which follows the outer circumferential shape of the tool engagement portion 6. Consequently, it is possible to prevent a risk of the thickness of the tool engagement portion 6 being increased locally, thereby making it possible to realize a reduction in weight of the tool engagement portion 6 and hence of the housing 2. As a result, it is possible to realize an improvement in fuel economy of the vehicle and a reduction in manufacturing cost of the glow plug.

Further, the thickness of the tool engagement portion 6 is 1.5 mm or smaller, whereby the thickness of the tool engagement portion 6 can be reduced sufficiently. Consequently, the weight of the housing 2 can be reduced further, whereby it is possible to realize more effectively the improvement in fuel economy of the vehicle and the reduction in manufacturing cost of the glow plug.

In addition, in this embodiment, the thickness of the tool engagement portion 6 is made uniform and the whole region of the tool engagement portion 6 is formed thin. Consequently, the weight of the housing 2 can be reduced further, and the working effect of improving the fuel economy or the like can be exhibited more effectively.

Additionally, in this embodiment, the area of the projected region AR2 of the step portion 16 is 30% or larger of the area of the region AR1 which is surrounded by the projected line VL of the outer circumferential surface of the tool engagement portion 6. Consequently, the contact area of the seal member 19 with the step portion 16 can be increased largely. As a result, the extremely good gastightness can be realized in the interior of the housing 2.

In addition, since the housing 2 is formed thin as a whole, the weight of the housing 2 can be reduced further. As a result, it is possible to realize the improvement in fuel economy of the vehicle and the reduction in manufacturing cost of the glow plug more effectively.

Further, in this embodiment, the holding portion 20 has the smallest outer diameter in the front-end-side body portion 9. Consequently, when an axial force is applied to the front-end-side body portion 9 in association with the mounting of the glow plug 1 in the internal combustion engine, the axial force is decomposed (i.e., broken down) towards the heater member 3. Because of this, even if the housing 2 (the front-end-side body portion 9) is formed thin as in this embodiment, it is possible to prevent the reduction in holding force with which the heater member 3 is held by the holding portion 20 in a more ensured fashion.

Further, deep drawing processing is performed to the plate-shaped metal material MB to manufacture the housing intermediate product 31 which is to become the housing 2. Consequently, it is possible to facilitate the manufacturing of the housing 2 which is thin and light in weight as a whole, thereby making it possible to realize an improvement in productivity.

The invention is not limited to what is described in the embodiment and, for example, may also be carried out in the following manners. Naturally, it is, of course, possible to adopt other application and modified examples which will not be exemplified below.

(a) In the embodiment described above, while the control coil 13 is interposed between the heating coil 12 and the center pole 11 to prevent the excessive rise in temperature or overshoot of the heating coil 12, the control coil 13 may be omitted by bringing the heating coil 12 into direct contact with the center pole 11.

(b) In the embodiment described above, the heater member 3 is configured by the tube 10 and the heating coil 12 and the like which are disposed in the interior of the tube 10, and in this respect, the technical concept of the invention is applied to the so-called metal glow plug. In contrast with this, the technical concept of the invention may be applied to a so-called ceramic glow plug in which a heater member is configured by a cylindrical base member which is made of an insulation ceramic and a heating element which is provided in the base member, which is made of a conductive ceramic and which is energized via the center pole 11 to generate heat. Additionally, in this case, a heater member may be used which includes a conductive film which is provided on an external surface of the base member to constitute a heating element (a so-called surface heating type heater). Further, at least part of the heating element may be formed of a conductive metal (for example, an alloy containing tungsten as a main composition) which has superior heat resistance.

(c) In the embodiment described above, while the rear end portion (the cable connecting portion) of the glow plug 1 is configured so that the terminal pin 17 is crimped and fixed to the rear end of the center pole 11, the configuration of the rear end portion of the glow plug 1 is not limited thereto. Consequently, for example, a configuration may be adopted in which an external thread is provided on an outer circumference of a portion of the center pole 11 which projects from the rear end of the housing 2, and a nut having an internal thread on an inner circumference thereof is screwed on the external thread while the nut is in contact with the insulating bush 18, so that the rear end portion of the center pole projects from the nut. Namely, the rear end portion of the center pole may be configured as the cable connecting portion.

Figure 8:
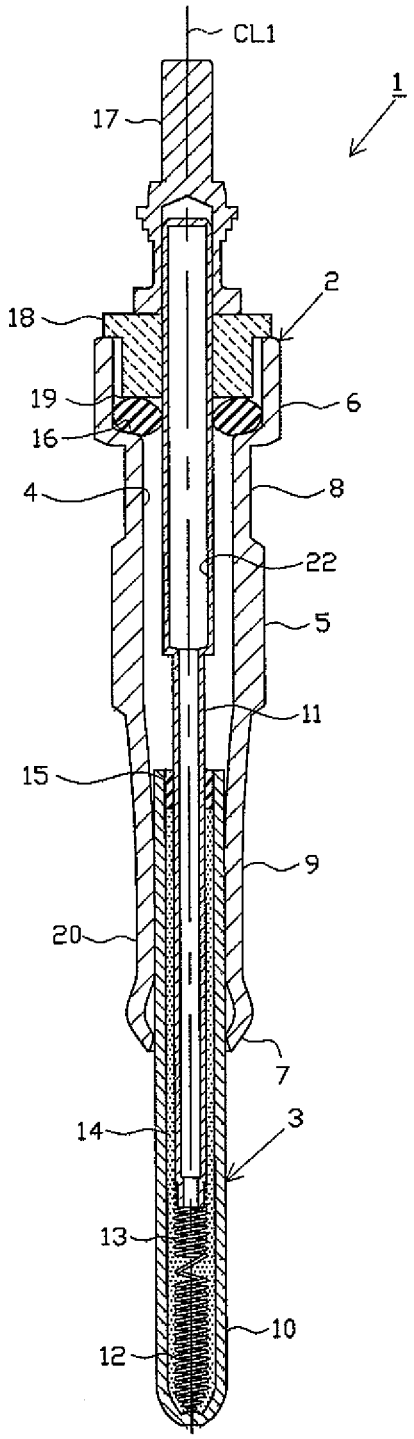
FIG. 8 is a sectional view showing the configuration of a glow plug of another embodiment.

(d) In the embodiment described above, while the center pole 11 is formed as the solid rod-like member, as shown in FIG. 8, a hollow portion 22 may be provided in the center pole 11 so that the center pole 11 is formed into a tubular member. In this case, a further reduction in weight of the glow plug 1 can be realized, thereby making it possible to realize a further improvement in fuel economy. Additionally, since the heat of the heater member 3 (the heating coil 12) conducted to the center pole 11 can be reduced, the heater member 3 (the heating coil 12) is allowed to reach the predetermined temperature quickly, and also electric power necessary to allow the heater member 3 to reach the predetermined temperature can be reduced. Further, it is possible to prevent the heat conduction from the control coil 13 to the center pole 11 in an effective fashion, whereby the temperature and hence resistance value of the control coil 13 can be increased more quickly. As a result, the control coil 13 is allowed to exhibit its original function quickly, and also a conservation of electric power can be realized.

(e) In the embodiment described above, while the housing 2 is formed thin as a whole and has substantially the uniform thickness, only the tool engagement portion 6 may be formed thin. Additionally, it is only necessary for the tool engagement portion 6 that an inner circumference thereof has a shape that follows the outer circumference shape thereof, and the thickness of the tool engagement portion 6 is not limited to those described in the embodiment above.

(f) In the embodiment described above, the housing intermediate product 31 is formed through deep drawing processing, and the inner circumference of the tool engagement portion 6 follows the shape of the outer circumference thereof by pressing the engagement-portion corresponding portion 32 of the housing intermediate product 31 into the outer circumference forming portion OM in the die D1. However, the method for manufacturing the housing intermediate product 31 and the method for forming the tool engagement portion 6 are not limited to those described in the embodiment. Consequently, for example, a housing intermediate product may be obtained by forging a predetermined metal material. Additionally, the inner circumference of the tool engagement portion may be formed into a shape which follows the outer circumference of the tool engagement portion by pressing an engagement-portion corresponding portion of the housing intermediate product into an outer circumference forming portion of a die, and after that, pressing a punch which is hexagonal in cross section into an inner circumference of a rear end portion of the housing intermediate product. In addition, the inner circumference of the tool engagement portion may be formed into a shape which follows the outer circumference of the tool engagement portion by cutting an inner circumference of the engagement-portion corresponding portion.

(g) In the embodiment described above, while the outer circumference and the inner circumference of the front-end-side body portion 9 are formed into the curved surfaces and the front-end-side body portion 9 has the uniform thickness, the shape of the front-end-side body portion 9 is not limited thereto. Consequently, for example, an outer diameter of the front-end-side body portion 9 may be constant along the direction of the axis CL1, and only the holding portion 20 of the front-end-side body portion 9 may be caused to project radially inwards, so that only the holding portion 20 is formed relatively thick.

(h) In the embodiment described above, while the tool engagement portion 6 is hexagonal in cross section, the shape of the tool engagement portion 6 is not limited to that shape. Consequently, for example, the tool engagement portion 6 may have a Bi-HEX shape (a modified dodecagonal shape) [IS022977:2005(E)] or the like.

(i) There is imposed no specific limitation on the shape of the heater member 3, and hence, for example, the heater member 3 may have an elliptic cross-sectional shape or an oval cross-sectional shape, or a polygonal cross-sectional shape. In addition, a so-called plate heater in which a plurality of plate-shaped insulating base members are formed and a heating element is sandwiched therebetween may be used as the heater member.

(j) The materials described as configuring the heating coil 12 and the control coil 13 in the embodiment described above are only the examples, and hence, there is imposed no specific limitation on the material of which the heating coil 12 or the like is configured by.

DESCRIPTION OF REFERENCE NUMERALS AND CHARACTERS

1 glow plug;
2 housing;
3 heater member;
4 axial hole;
5 screw portion;
6 tool engagement portion;
11 center pole;
16 step portion;
19 seal member;
31 housing intermediate product;
CL1 axis;
MB metal material.

Having described the invention, the following is claimed:

1. A glow plug comprising:

a housing having an axial hole, a screw portion, and a tool engagement portion, the axial hole extending in a direction of an axis, the screw portion being on an outer circumferential surface of the housing, said screw portion being dimensioned to be screwed into a mounting hole of an internal combustion engine, the tool engagement portion being provided at a rear end side of the screw portion, said tool engagement portion being dimensioned to engage a tool when said housing is mounted to the internal-combustion engine;

a heater member inserted into the axial hole in a state where at least a front end portion thereof projects from a front end of the housing;

a center pole extending in the direction of the axis, inserted through the axial hole and electrically connected with the heater member; and an annular seal member in contact with an inner circumference of the tool engagement portion and an outer circumference of the center pole, wherein, along an axial length of the tool engagement portion, the inner circumference of the tool engagement portion has a shape that follows a shape of an outer circumference of the tool engagement portion, wherein the housing further has an annular step portion that is located on the inner circumference of the tool engagement portion, the annular step portion projecting radially inwards and being in contact with the seal member, and wherein, when a surface of the outer circumference of the tool engagement portion, a surface of the outer circumference of the center pole, and a surface of an outer circumference of the step portion are projected along the axis on a plane perpendicular to the axis, an area of a first projected region defined between the outer circumferential surface of the center pole and the outer circumferential surface of the step portion is 30% or more of an area of a second projected region defined by the outer circumferential surface of the tool engagement portion.

2. The glow plug according to claim 1, wherein in a cross-sectional plane perpendicular to the axis, the outer circumferential shape of the tool engagement portion is hexagonal, and wherein any one of the following (a) to (c) is satisfied:

(a) a distance between opposite sides of the tool engagement portion is 8 mm, and a thickness of the tool engagement portion is 0.8 mm or smaller;

(b) the distance between the opposite sides of the tool engagement portion is 9 mm or 10 mm, and the thickness of the tool engagement portion is 1.0 mm or smaller;

(c) the distance between the opposite sides of the tool engagement portion is 12 mm, and the thickness of the tool engagement portion is 1.5 mm or smaller.

3. The glow plug according to claim 1, wherein the tool engagement portion has a uniform thickness.

4. A method for manufacturing a glow plug, the glow plug including a housing having an axial hole, a screw portion, and a tool engagement portion, the axial hole extending in a direction of an axis, the screw portion being on an outer circumferential surface of the housing, said screw portion being dimensioned to be screwed into a mounting hole of an internal combustion engine, the tool engagement portion being provided at a rear end side of the screw portion, said tool engagement portion being dimensioned to engage a tool when said housing is mounted to the internal combustion engine, the glow plug including a center pole extending in the direction of the axis, inserted through the axial hole and electrically connected with a heater member, the glow plug including an annular seal member in contact with an inner circumference of the tool engagement portion and an outer circumference of the center pole, the inner circumference of the tool engagement portion having a shape along an axial length thereof that follows a shape of an outer circumference of the tool engagement portion, the housing further having an annular step portion that is located on the inner circumference of the tool engagement portion, the annular step portion projecting radially inwards and being in contact with the seal member, the method comprising:

forming the housing, the forming of the housing including forming a housing intermediate product that is to become the housing by performing deep drawing processing to a plate-shaped metal material; and inserting the heater member into the axial hole in a state where at least a front end portion thereof projects from a front end of the housing, wherein, when a surface of the outer circumference of the tool engagement portion, a surface of the outer circumference of the center pole, and a surface of an outer circumference of the step portion are projected along the axis on a plane perpendicular to the axis, an area of a first projected region defined between the outer circumferential surface of the center pole and the outer circumferential surface of the step portion is 30% or more of an area of a second projected region defined by the outer circumferential surface of the tool engagement portion.

5. The glow plug according to claim 1, wherein the inner circumferential shape of the tool engagement portion extends along the axial length of the tool engagement portion for an entirety of the inner circumference of the tool engagement portion.

* * * * *